US006363851B1

(12) United States Patent
Gerhard et al.

(10) Patent No.: US 6,363,851 B1
(45) Date of Patent: Apr. 2, 2002

(54) PROCESS FOR PRODUCING FOLDED, BOUND PRINTED PRODUCTS, AND THE PRINTED PRODUCT PRODUCED

(75) Inventors: Jakob Gerhard; Robert Glur, both of Brittnau (CH)

(73) Assignee: Hunkeler AG, Wikon (CH)

( * ) Notice: Subject to any disclaimer, the term of this patent is extended or adjusted under 35 U.S.C. 154(b) by 0 days.

(21) Appl. No.: 09/450,026

(22) Filed: Nov. 29, 1999

(30) Foreign Application Priority Data

Nov. 27, 1998 (CH) ..... 2366/98

(51) Int. Cl.[7] ..... B41F 1/34; B41J 11/26; B42D 15/00; B42D 1/00

(52) U.S. Cl. ..... 101/483; 283/31; 281/15.1; 270/1.01; 270/1.03; 270/37; 270/52.09; 400/621.1

(58) Field of Search ..... 101/483, 226, 101/227; 400/621, 621.1; 270/1.01, 4, 5.01, 8, 9, 12, 15, 16, 20.1, 21.1, 1.03, 52.02, 37, 52.09, 52.16; 283/31, 56; 281/15.1, 40; 206/232, 449; 156/257, 366

(56) References Cited

U.S. PATENT DOCUMENTS

| | | | | |
|---|---|---|---|---|
| 2,551,555 A | | 5/1951 | Boyajian | |
| 3,612,264 A | * | 10/1971 | Trunick | 206/449 |
| 3,679,200 A | * | 7/1972 | Bailey et al. | 270/4 |
| 4,279,409 A | * | 7/1981 | Pemberton | 270/5 |
| 4,667,983 A | * | 5/1987 | Spolander | 156/366 |
| 4,824,503 A | * | 4/1989 | Wilen | 270/20.1 |
| 5,087,078 A | * | 2/1992 | Phillips | 283/31 |
| 5,098,127 A | * | 3/1992 | Williamson | 281/15.1 |
| 5,114,128 A | * | 5/1992 | Harris, Jr. et al. | 270/11 |
| 5,207,456 A | * | 5/1993 | Dawhoffe | 281/40 |
| 5,419,587 A | * | 5/1995 | McClure | 283/56 |
| 5,568,942 A | * | 10/1996 | Stevens | 283/56 |
| 5,590,912 A | * | 1/1997 | Stevens | 283/56 |
| 5,618,062 A | * | 4/1997 | Mertens et al. | 283/67 |
| 5,678,813 A | * | 10/1997 | Osako et al. | 270/52.6 |
| 5,707,474 A | * | 1/1998 | Andersen et al. | 156/257 |
| 5,749,567 A | * | 5/1998 | DeAngelis | 270/20.1 |
| 5,765,874 A | | 6/1998 | Chanenson et al. | |
| 5,776,591 A | * | 7/1998 | Mertens | 283/105 |
| 6,146,035 A | * | 11/2000 | Ishigouoka et al. | 400/621 |
| 6,296,112 B1 | * | 10/2001 | Pettey | 206/232 |

FOREIGN PATENT DOCUMENTS

| | | |
|---|---|---|
| EP | 0 743 182 A | 1/1993 |
| WO | WO 94 29117 | 3/1994 |

* cited by examiner

*Primary Examiner*—Eugene Eickholt
(74) *Attorney, Agent, or Firm*—Oliff & Berridge, PLC

(57) ABSTRACT

A folded, bound printed product comprising a plurality of printed subproducts is produced in that an initial product is printed sequentially in such a manner as to produce a series of printed subproducts which are to be arranged one after the other, the initial product has a weakening line or the printed subproducts are provided with a weakening line, and the printed subproducts are collated, folded and bound.

11 Claims, 2 Drawing Sheets

PROCESS FOR PRODUCING FOLDED, BOUND PRINTED PRODUCTS, AND THE PRINTED PRODUCT PRODUCED

BACKGROUND OF THE INVENTION

1. Field of Invention

The invention relates to a method for producing folded, bound printed products. The invention also relates to the folded printed product.

2. Description of Related Art

It is known for printed products to be produced such that their individual pages are printed continuously by an electronic printer and these continuous pages are then stacked, bound and folded. This electronic printing makes it possible to produce one complete printed product after the other, it being possible for two printed products which are produced one after the other to have different contents and/or numbers of pages.

The disadvantage of this process is the fact that the maximum number of pages of folded printed products produced in this way is limited. Thick printed products can only be folded with very great difficulty, if at all. In addition, both thick printed products and thin printed products have a round, convex spine, which takes up more space and is not aesthetically pleasing.

SUMMARY OF THE INVENTION

The object of the invention is to provide a process which is intended for producing a bound printed product and makes it possible to produce more advantageously configured printed products.

The object is achieved, in particular, by a process for producing folded, bound printed products comprising a plurality of printed subproducts, in which an initial product is printed sequentially in such a manner as to produce a series of printed subproducts (pages) which are to be arranged one after the other, the initial product has a weakening line or the printed subproducts are provided with a weakening line, and the printed subproducts are collated, folded along the weakening line and bound.

The process according to the invention ensures that the printed subproducts have a weakening line, for example a folding, scoring or crease line, before they are folded, with the result that, during folding, the printed subproducts bend along the weakening line, which provides the advantage of it being possible for thick and thin printed products to be folded neatly, it being possible for even very thick printed products, i.e. printed products comprising a multiplicity of pages, to be folded.

In an advantageous process step, two spaced-apart weakening lines are provided on the printed subproduct, the spacing between said weakening lines preferably being increased in successive printed subproducts. This makes it possible to produce folded, bound printed products with a, for example, flat spine.

BRIEF DESCRIPTION OF THE DRAWINGS

The invention is explained hereinbelow by way of exemplary embodiments and with reference to the drawings, in which.

DETAILED DESCRIPTION OF PREFERRED EMBODIMENTS

Figure 1:
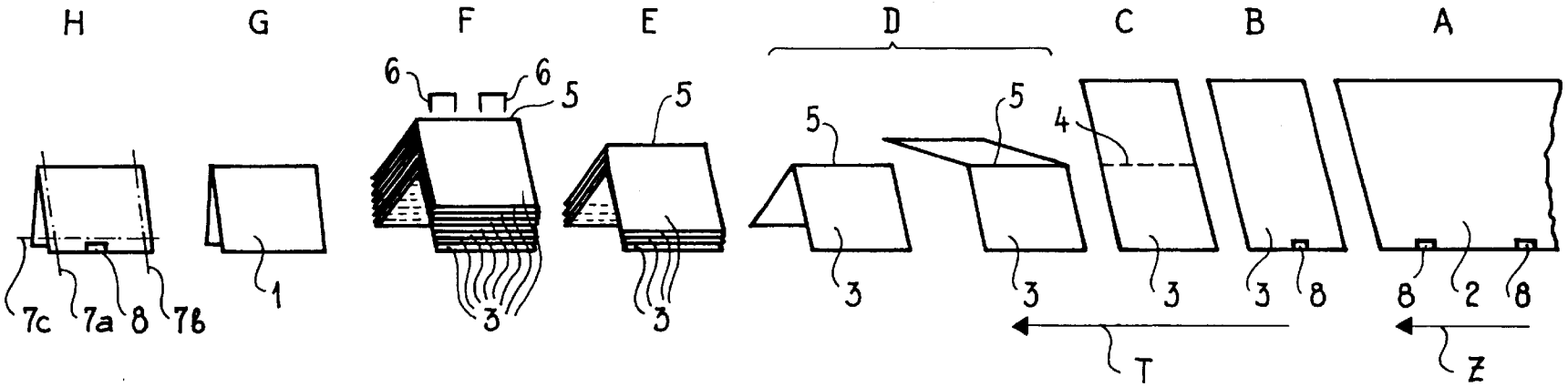
FIG. 1 shows, a process for producing folded, bound printed products.

FIG. 1 shows the process steps for producing a folded, bound printed product 1 from an initial product 2.

The initial product 2 illustrated in the processing step A is delivered in the conveying direction Z in a printed paper web. An electronic printer (not illustrated), for example a laser printer, has printed the paper web continuously. In the processing step B, a sheet is cut off from the initial product 2 in each case to form a printed subproduct 3. It would be possible for the printed subproduct 3 to be configured, for example, as a sheet of A3 format which runs transversely to the conveying direction T. In the following processing step C, the printed subproduct 3 is, for example, scored and thus provided with a weakening line 4 running in the conveying direction T. In the following processing step D, the printed subproduct 3 is bent along the weakening line 4, a fold 5 being formed in the process, with the result that the printed subproduct 3 takes on a roof form. In the processing step E, the printed subproducts 3 are collected on a saddle-like stack. As soon as all the printed subproducts 3 belonging to a printed product 1 have been collected on the stack, the stack is transferred to the processing step F, in which the stack is aligned by a jogging action and one or more staples 6 are then provided in the fold 5 in order to staple and/or bind the individual subproducts 3. In the process step G, the stapled printed product 1 is nipped in order to make the spine as narrow as possible. Thereafter, in a further process step H, the printed product 1 is cut on the front side 7*c* and/or along the lateral sides 7*a*, 7*b*.

The initial product 2 may be advantageously provided with individually printed markers 8 by the printer, such that each printed out product 3 has at least one individual marker 8. By way of this marker 8, for example, the page number or the sequence of a series of pages can be applied individually to each printed subproduct 3. The marker 8 may also indicate, for example, the end of a sequence, with the result that a reader can help detect as to whether all the necessary printed subproducts 3 are present or collated or whether, for example, the printed subproducts 3 can be stapled. FIG. 1 shows, by way of example, individual printed subproducts 3 provided with a marker 8. A plurality of sensors (not illustrated) arranged along the conveying direction T can monitor the processing of each printed subproduct 3 and establish, in particular, the correct sequence or the absence of a printed subproduct 3. It is also possible to establish when all the required printed subproducts 3 have been collated in process step E and when to initiate the stapling according to process step F. The marker 8 can be removed by the cutting in process step H.

In a further, advantageous process, it is also possible, in process steps B, D and/or E, for another sheet 3, which does not originate from the initial product 2, to be fed, said sheet 3 serving, for example, as a cover. For this purpose, for example, the feeding operation in the process step A is stopped and one or more sheets 3 are fed to the processing step B from the outside, said sheets 3 being fed to the downstream processing steps, as seen in the conveying direction T. This sheet 3 may have, for example, a punched-out window, with the result that it is possible to read the text of the printed subproduct 3 located therebeneath.

It is also possible, in the process step A, for the initial product 2 to be fed in the form of a non-printed paper web. The initial product 2 being cut in the process step B and the individual sheets being printed to produce a printed subproduct 3. In addition, it is also possible for the initial product 2 to be fed in the form of individual sheets. The initial product 2 may consist of any printable material, in particular also of a plastic.

The process according to FIG. 1 could also be configured such that the initial product 2 already has a weakening line 4 running in the conveying direction T, thus making it possible to dispense with the processing step C. This initial product 2 having a weakening line 4 could be configured as a roll or as a stack of individual sheets.

In the process according to FIG. 1, the process steps D and E could also be changed round such that first of all the printed subproducts 3 are collected in a flat state and layered one above the other and then all the collected printed subproducts 3 are aligned and bent together along their weakening lines 4, a fold 5 being formed in the process.

Figure 2:
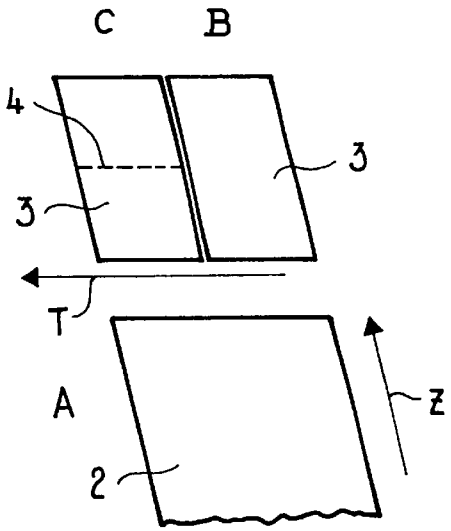
FIG. 2 shows a variant for feeding the initial products.

FIG. 2 shows a further possible way of feeding an initial product 2, in the processing step A, in a direction Z running perpendicularly to the conveying direction T. In the processing step B, the initial product 2 is halved in the running direction Z and also separated from the initial product 2 to form two printed subproducts 3, first of all the left-hand printed subproduct 3 being provided, in the processing step C, with a weakening line 4 and then being conveyed in the conveying direction T, whereupon the second printed subproduct 3 is subjected to the processing step C.

Figure 3:
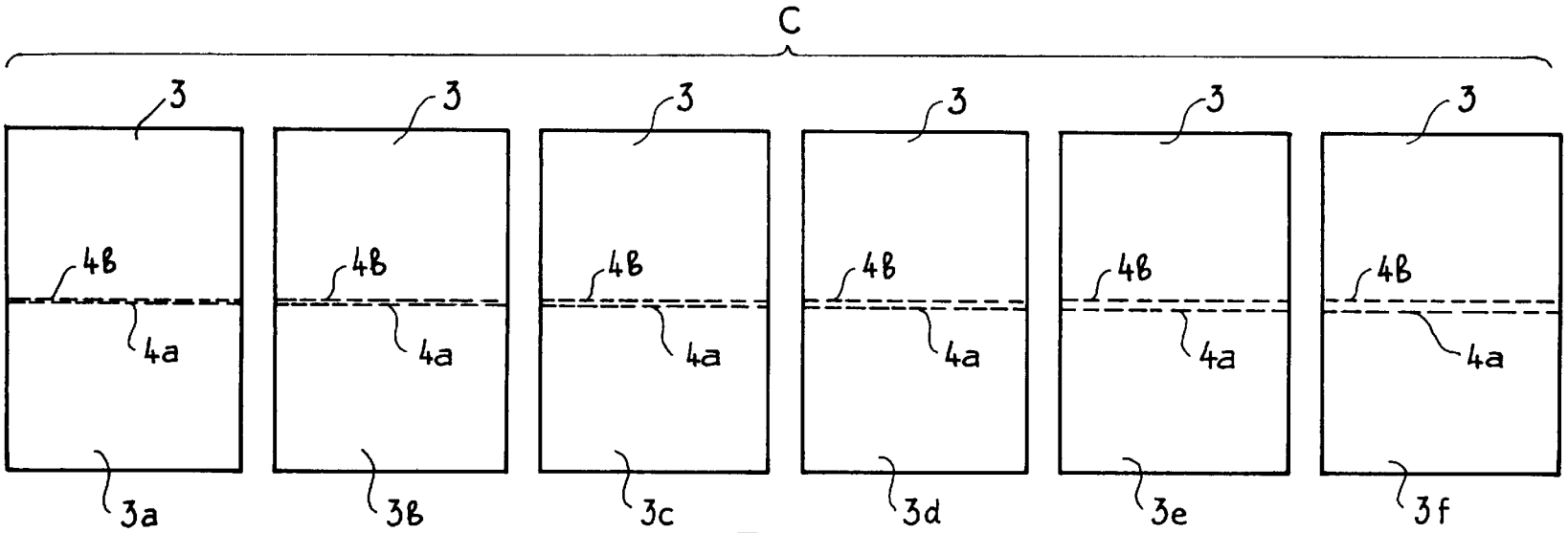
FIG. 3 shows a process for producing weakening lines with different spacings.

FIG. 3 shows a plurality of printed subproducts 3 provided one after the other, in the process step C, with weakening lines 4*a*, 4*b*. The printed subproduct 3*a*, which is the first to be processed, has a single weakening line or two weakening lines 4*a*, 4*b* which are spaced apart from one another by only a very small amount. The printed products 3*b*, 3*c*, 3*d*, 3*e* and 3*f*, which are next to be processed, each have two weakening lines 4*a*, 4*b* which are increasingly spaced apart from one another. For this purpose, the apparatus used in the processing step C has, for example, a scoring apparatus, of which the position can be adjusted in accordance with the weakening lines 4*a*, 4*b* which are to be produced.

Figure 4:
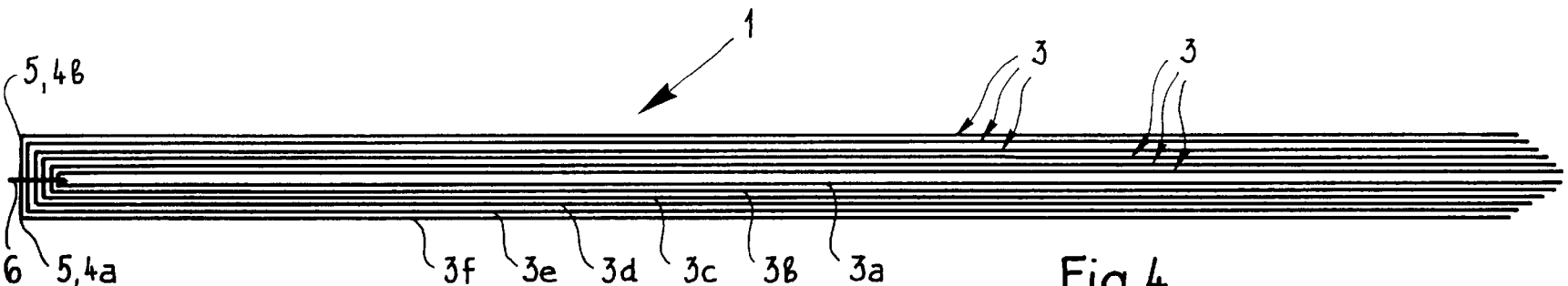
FIG. 4 shows a printed product.

FIG. 4 shows a side view of a printed product 1 which is stapled using a staple 6 and comprises printed subproducts 3; 3*a*, 3*b*, 3*c*, 3*d*, 3*e*, 3*f* with differently spaced-apart weakening lines 4*a*, 4*b* as illustrated in FIG. 3. The spacing between the weakening lines 4*a*, 4*b* or the resulting spacings between the bending locations 5 are selected individually for each printed subproduct 3*a*, 3*b*, 3*c*, 3*d*, 3*e*, 3*f* such that the printed product 1 has a rectilinear or more or less rectilinear spine with corners.

The text of the printed product 1 on the rectilinear or flat spine can thus always be read easily, which is advantageous, in particular, for archiving printed products. The above-described arrangements of the weakening lines 4*a*, 4*b* does not just result in a flat spine; at the same time, parallel alignment of the pages of the printed product 1 takes place, thus avoiding the troublesome situation where the book pages and book cover gape open. The above-described arrangement of the weakening lines 4*a*, 4*b* also provides the advantage of sufficient space always being provided for the means for joining the printed subproducts 3*a*, 3*b*, 3*c*, 3*d*, 3*e*, 3*f*.

Instead of using staples 6, the printed subproducts 3 could also be joined to one another by some other means, for example by adhesive bonding, in that, for example in the exemplary embodiment according to FIG. 4, those sections of the respective printed subproduct 3*a*, 3*b*, 3*c*, 3*d*, 3*e*, 3*f* which are arranged between the weakening lines 4*a*, 4*b* are provided with adhesive and thus held together. "Bound printed product" is taken to mean a plurality of printed subproducts 3 joined to one another, it being possible for the printed subproducts 3 to be bound or held together by a large number of different means, for example by stapling, adhesive bonding, binding with cords, etc.

While this invention has been described in conjunction with the specific embodiments outlined above, it is evident that many alternatives, modifications and variations will be apparent to those skilled in the art.

Accordingly, the preferred embodiments of the invention, as set forth above, are intended to be illustrative, not limiting. Various changes may be made without departing from the spirit and scope of the invention.

What is claimed is:

1. A process for producing folded, bound printed products comprising a plurality of printed subproducts, the process comprising:

printing sequentially an initial product in such a manner as to produce a series of printed subproducts which are to be arranged one after the other;

one of the initial product having two spaced-apart weakening lines, or providing two spaced-apart weakening lines to the printed subproducts, spacing between the weakening lines being increased in successive printed subproducts;

collating the printed subproducts;

folding the printed subproducts along the two spaced-apart weakening lines; and binding the printed subproducts along the two spaced-apart weakening lines.

2. The process of claim 1, further comprising feeding and printing the initial product as a paper web; and cutting the initial product into individual printed subproducts.

3. The process of claim 1, wherein the printed subproducts are collated as one of a flat and a saddle-like stack.

4. The process of claim 1, further comprising printing a control character onto the initial product in order for the printed subproducts to be at least partially individually marked.

5. The process of claim 1, wherein two spaced-apart weakening lines are provided on the printed subproducts.

6. The process of claim 5, wherein the spacing between the weakening lines is increased in successive printed subproducts.

7. The process of claim 1, further comprising positioning a cover on the collated printed subproducts.

8. The process of claim 1, further comprising cutting at least one edge of the printed products.

9. The process of claim 1, wherein the binding comprises stapling.

10. A folded, bound printed product, comprising a plurality of printed subproducts, the printed subproducts overlaying one another from an innermost printed subproduct to an outermost printed subproduct, at least those printed subproducts which are arranged in an outermost region of the printed product have two spaced-apart weakening lines running in the direction of a fold, said printed subproducts being folded along the two spaced-apart weakening lines and bound along the two spaced-apart weakening lines, wherein spacing between the weakening lines is increased in successive printed subproducts.

11. The folded printed product of claim 10, wherein the spacing between the weakening lines of a printed subproduct increases from the printed subproducts which are arranged innermost to the printed subproducts which are arranged in the outermost region.

* * * * *